United States Patent [19]

Weber

[11] Patent Number: 5,020,759

[45] Date of Patent: Jun. 4, 1991

[54] HOLDER FOR EXTENSION CORDS OR THE LIKE

[76] Inventor: Earl P. Weber, Rte. 1, Dunlap, Iowa 51529

[21] Appl. No.: 541,633

[22] Filed: Jun. 21, 1990

[51] Int. Cl.[5] ..... A47F 5/00

[52] U.S. Cl. ..... 248/309.2; 211/87

[58] Field of Search ..... 248/309.1, 309.2, 90, 248/91; 224/218; 294/143, 158; 211/87, 57.1, 60.1, 70.6, 105.1, 106

[56] References Cited

U.S. PATENT DOCUMENTS

| | | | |
|---|---|---|---|
| 283,728 | 8/1883 | Ward . | |
| 499,326 | 6/1893 | Masse . | |
| 928,530 | 7/1909 | Mowinckel | 211/59.1 X |
| 1,149,691 | 8/1915 | Seamans | 211/59.1 |
| 1,527,243 | 2/1925 | Wells | 211/59.1 X |
| 2,197,877 | 7/1938 | Racen . | |
| 2,754,974 | 7/1956 | Larson . | |
| 3,197,101 | 7/1965 | Brown | 294/158 |
| 3,792,822 | 2/1974 | Underhill . | |
| 4,344,540 | 8/1982 | Marschak | 211/106 X |
| 4,366,908 | 1/1983 | Anderson . | |
| 4,406,372 | 9/1983 | Bell | 211/59.1 X |
| 4,573,729 | 3/1986 | Cookson | 294/158 |
| 4,878,586 | 11/1989 | Bancroft | 211/87 X |

*Primary Examiner*—J. Franklin Foss

*Attorney, Agent, or Firm*—Zarley, McKee, Thomte, Voorhees & Sease

[57] ABSTRACT

A holder for extension cords or the like comprising a vertically disposed support having a plurality of support teeth extending substantially horizontally outwardly therefrom. The cord is supported on the support members in a looped fashion and a gate is then lowered with respect thereto to maintain the loops of the cord on the support members. The cord may be removed by pulling the same from the support members with the gate acting as a latching device which moves slightly upwardly as each loop is pulled from the holder while maintaining the remaining loops of the cord thereon.

8 Claims, 5 Drawing Sheets

HOLDER FOR EXTENSION CORDS OR THE LIKE

BACKGROUND OF THE INVENTION

This invention relates to a holder for extension cords or the like, and more particularly to a holder which prevents the extension cords or the like from becoming tangled during storage.

Electrical cords frequently become tangled when they are being stored. Many attempts have been made to provide suitable devices for storing and mounting the electrical cords thereon. However, although many of the devices permit the convenient coiling of the extension cord thereon, it is difficult or inconvenient to remove the cord therefrom when it is desired to use the cord. Further, the conventional cord holders of which applicant is aware have limited storage capabilities. Yet another disadvantage of the prior art devices is that if two cords are to be stored on the device, the first cord coiled on the device can only be removed upon removal of the second cord coiled thereon.

Therefore, it is principal object of the invention to provide an improved holder for extension cords or the like.

A further object of the invention is to provide an extension cord holder having an auxiliary holder mounted thereon.

Yet another object of the invention is to provide an extension cord holder wherein a pair of cords may be individually mounted thereon.

Still another object of the invention is to provide an electrical cord holder having a gate means provided thereon which maintains the cord thereon at times and which permits successive loops of the cord to be removed therefrom at times.

Still another object of the invention is to provide an extension cord holder which may be hand held or wall mounted.

Still another object of the invention is to provide an electrical cord holder which is convenient to use.

These and other objects of the present invention will be apparent to those skilled in the art.

SUMMARY OF THE INVENTION

Figure 2:
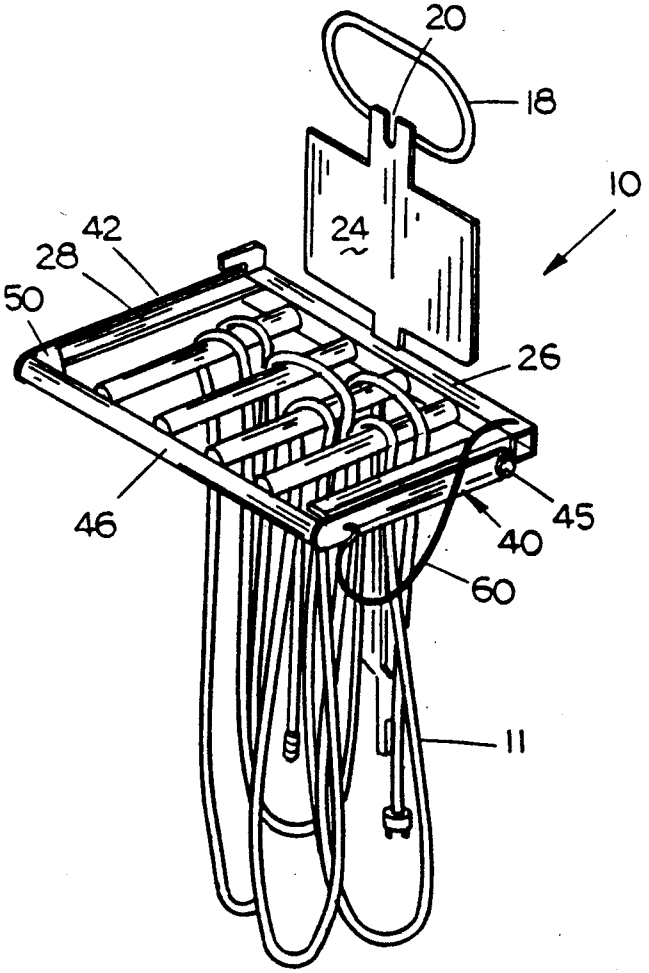
FIG. 2 is a view similar to FIG. 1 except that an extension cord has been stored thereon.

A holder for extension cords and the like is described including a substantially vertically disposed support having a plurality of horizontally spaced apart support members extending forwardly therefrom for receiving loops of the cord thereon. A U-shaped gate is pivotally mounted on the support and has a front member which is positioned in front of the forward ends of the horizontally extending frame members when the gate means is in its cord retaining position. The gate means may be pivotally moved upwardly to an inoperative position to permit the cords to be coiled or looped on the horizontally extending support members. When the gate means is in its cord retaining position and is not locked into that position, individual loops of the cord may be pulled from the support members since the gate will automatically pivotally move upwardly to permit the coil to pass thereby. In one form of the invention, an auxiliary cord support means is positioned on the support members and may be removed therefrom when the electrical cord has been mounted thereon.

DESCRIPTION OF THE PREFERRED EMBODIMENT

The holder of this invention is referred to generally by the reference numeral 10 and is ideally suited for holding or storing an extension cord(s) 11 thereon although the device will accommodate any elongated flexible members such as rope, welding bases, etc.

Holder 10 includes a support member 12 having an upper end 14 and a lower end 16. Handle 18 is provided at the upper end of the support 12 to permit the unit to be carried at times. Slot 20 is provided in the upper end of support 12 and slot 22 is provided in the lower end of support 12 to enable the device to be secured to a vertically disposed supporting member such as a wall or the like by extending nails or screws through the slots 20 and 22. Plate 24 is secured to the front side of support 12 as seen in the drawings.

A horizontally disposed tube 26 is secured to support member 12 below plate 24 and has a pair of angle members 28 and 30 secured to the opposite end thereof which extends forwardly and slightly upwardly at approximately a 10 angle therefrom. Support members or teeth 32, 34, 36 and 38 are secured to tube 26 between angle members 28 and 30 as seen in the drawings and extend forwardly and slightly upwardly therefrom as seen in the drawings.

Figure 1:
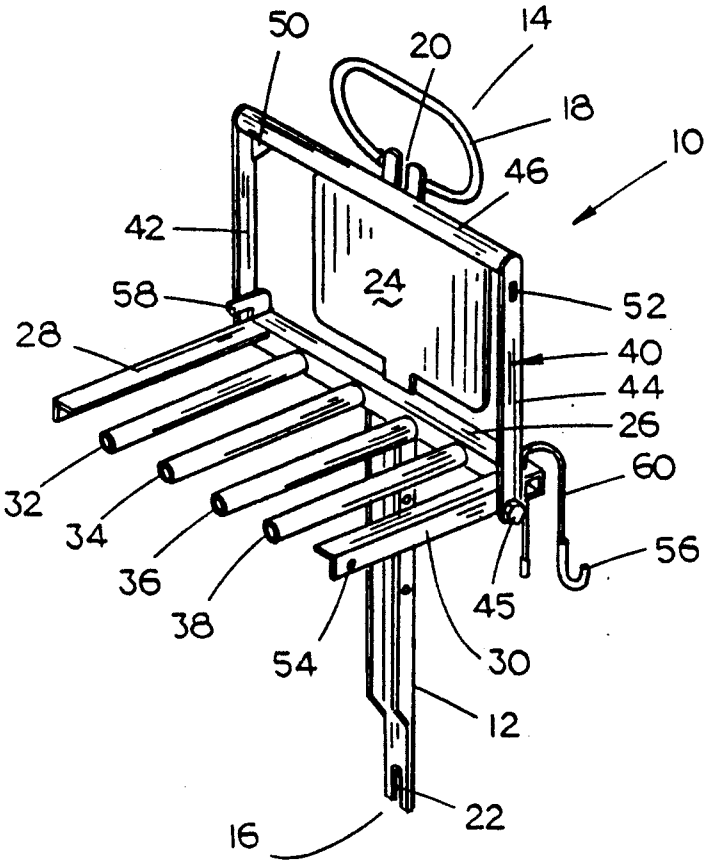
FIG. 1 is a perspective view of the extension cord holder of this invention.
Figure 3:
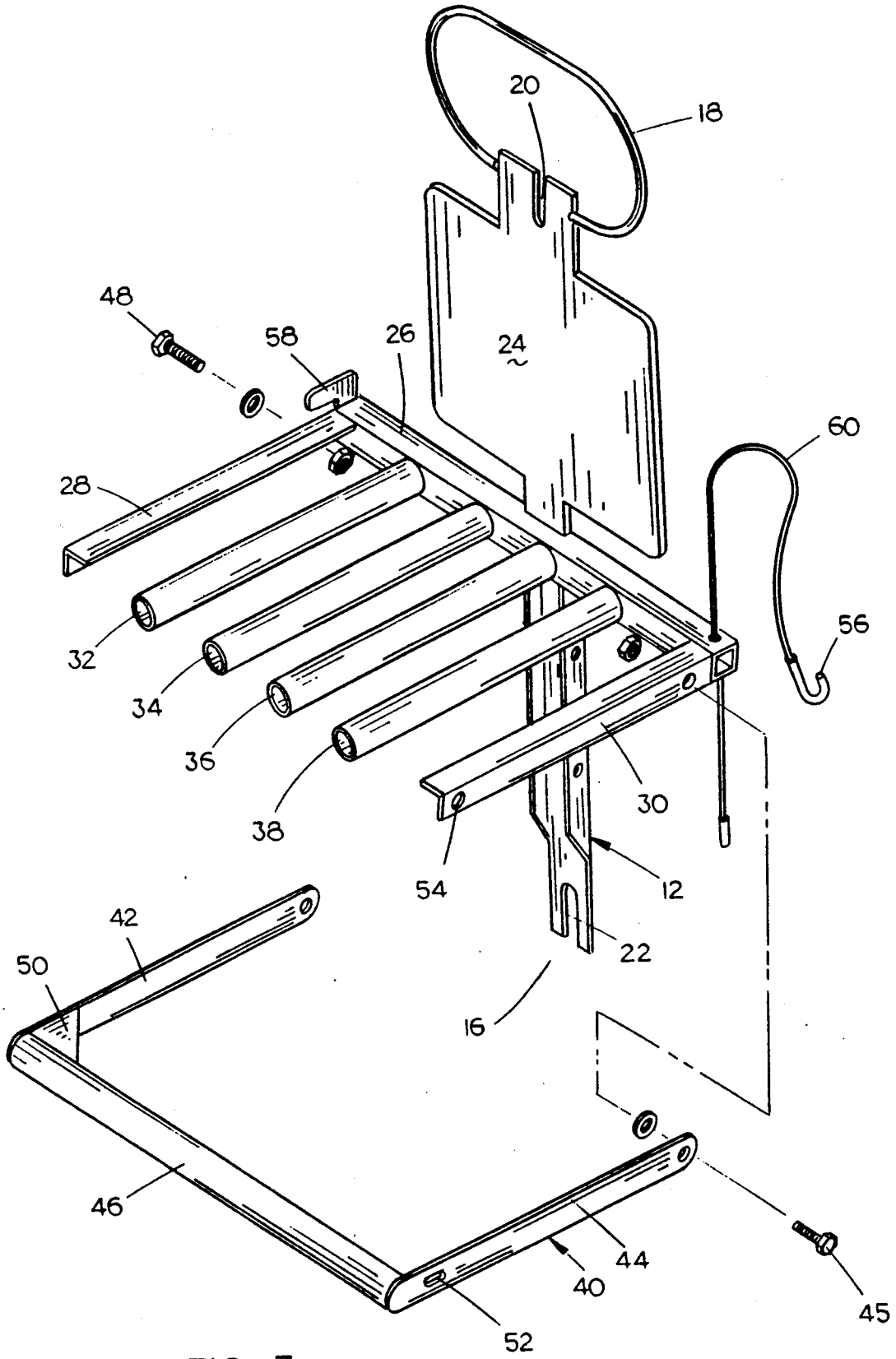
FIG. 3 is an exploded perspective view of the holder of this invention.
Figure 4:
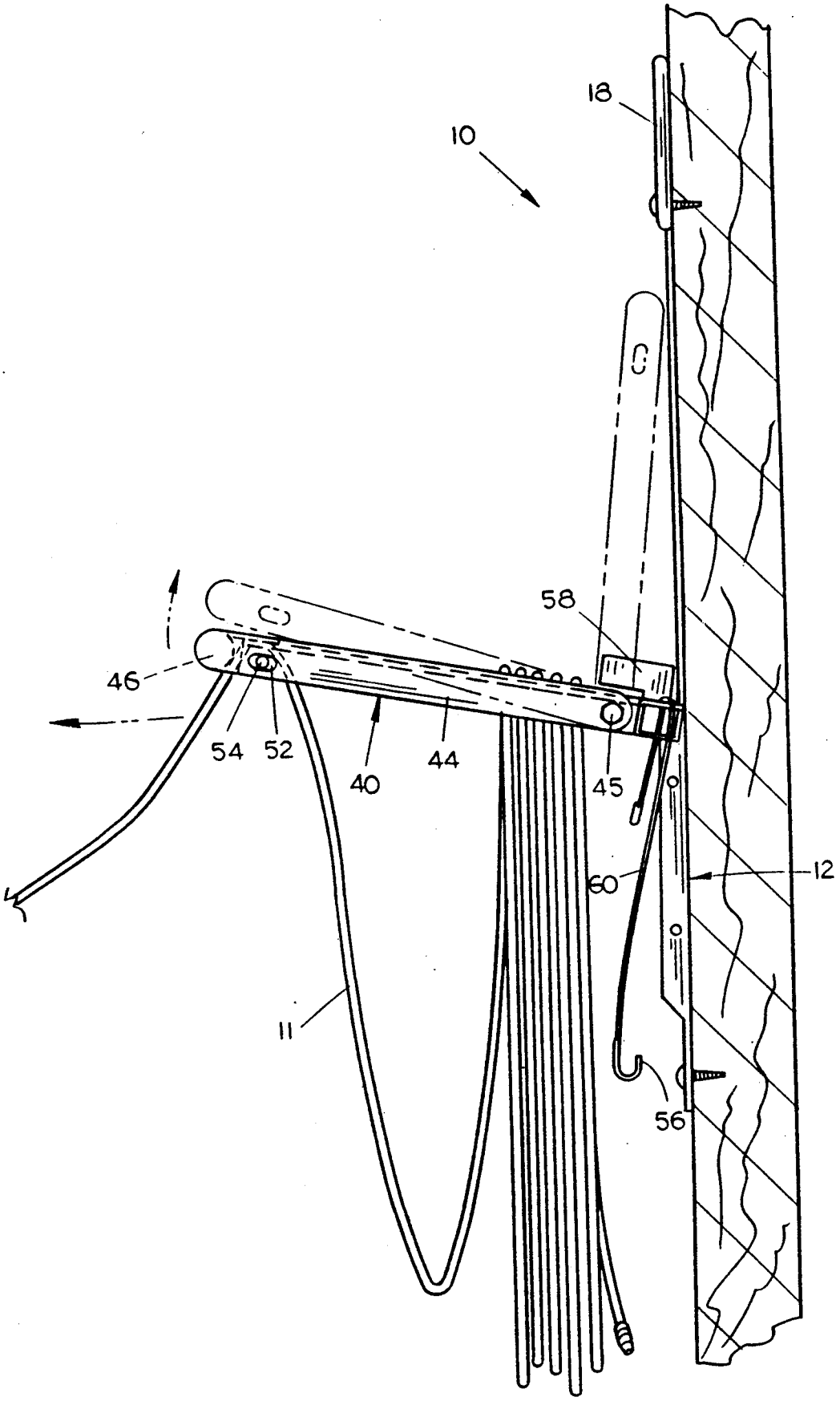
FIG. 4 is a side view of the holder illustrating the manner in which the extension cord is removed from the holder.
Figure 5:
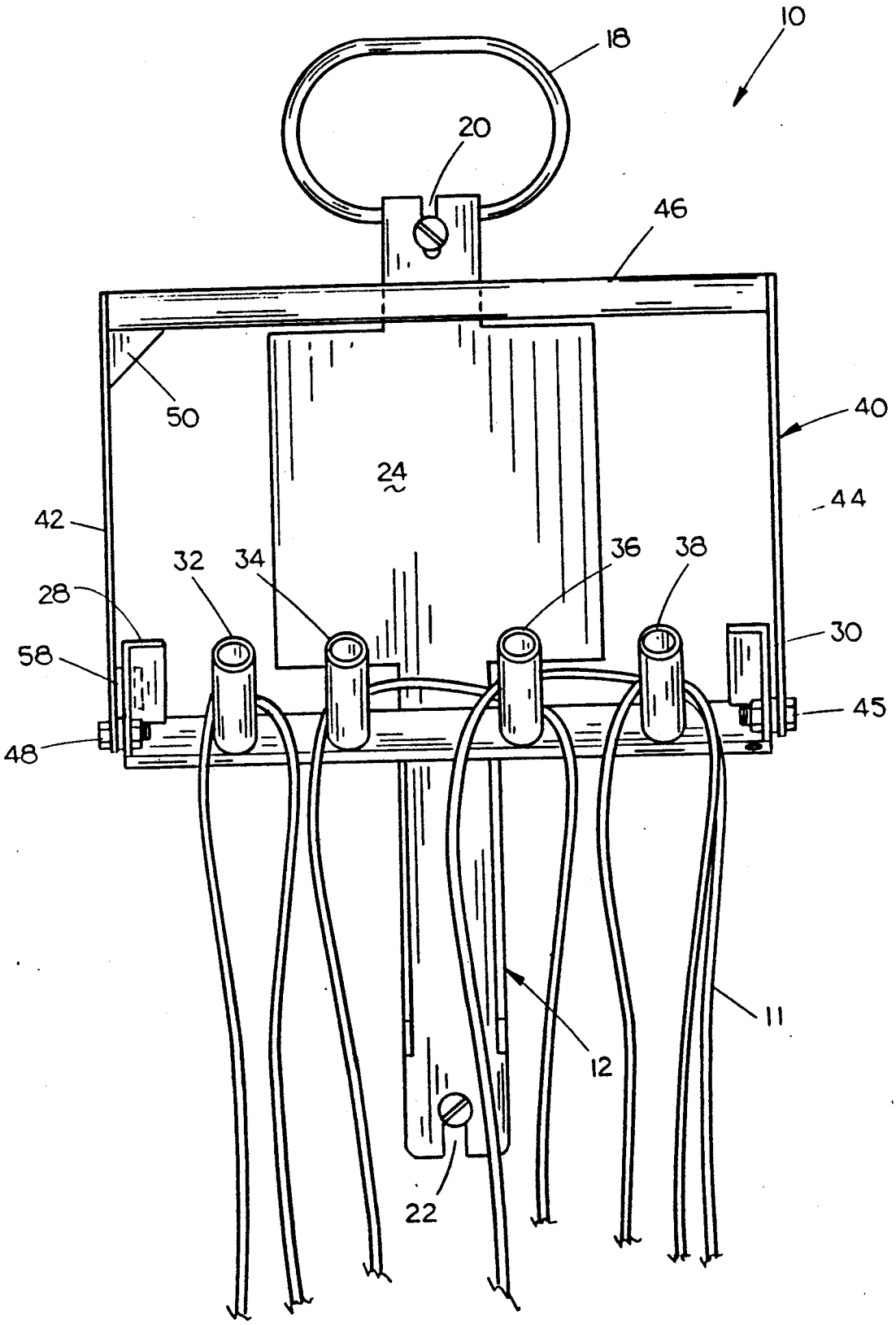
FIG. 5 is a front view of the holder with the cord retainer in an inoperative position.
Figure 6:
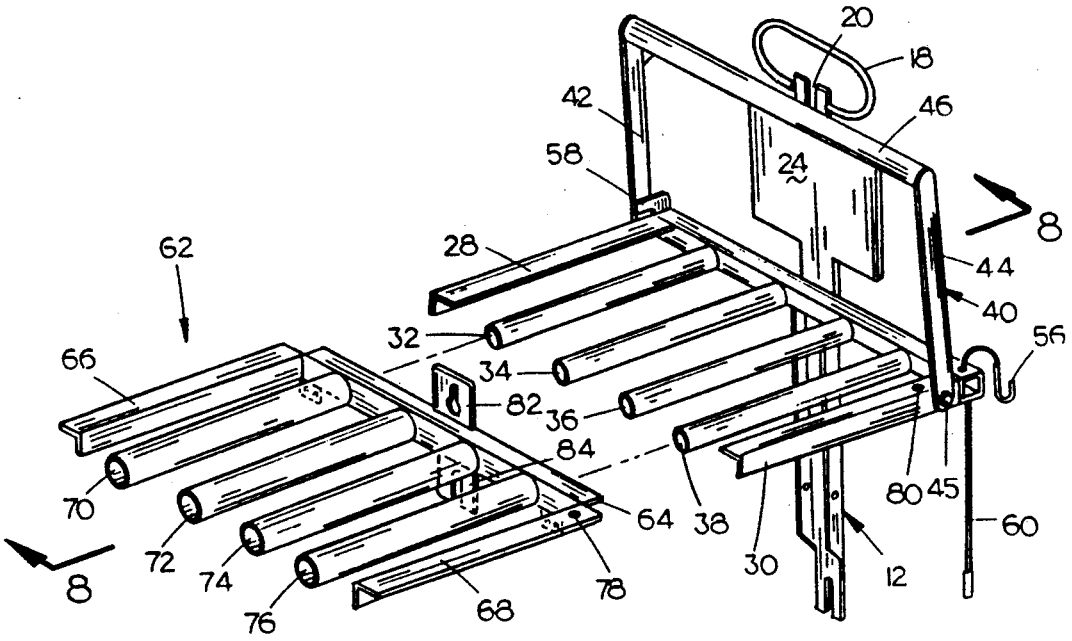
FIG. 6 is a perspective view similar to FIG. 1 except that an auxiliary cord holder is illustrated.

The numeral 40 refers to a gate means including side members 42 and 44 having a front member 46 extending between the forward ends thereof. The rearward ends of side members 42 and 44 are to angle members 28 and 30 by means of bolts 46 and 48 respectively. Gusset 50 (FIG. 2) is secured to and extends between side member 42 and front member 46 at the juncture thereof and is adapted to rest upon the forward end of angle member 28 to limit the downward movement of gate means 46 with respect to the angle members 28 and 30 and the teeth 32, 34, 36 and 38. Side member 44 is provided with an opening 52 formed therein which is adapted to register with opening 54 formed in the forward end of angle member 30 to enable a hook 56 to be extended therethrough to lock the gate means in its lowered position. Gate means 40 may be pivotally moved from its substantially horizontally disposed locked position as illustrated in FIG. 2 to an upper inoperative position as illustrated in FIG. 1. The numeral 58 refers to a small ear which is secured to the end of tube 26 which is adapted to (frictionally engage side member 42 when the gate means is moved to its inoperative position to frictionally maintain the gate means in its inoperative position at times. Cord 60 is secured to hook 56 with the other end of the cord 60 being secured to the end of tube 26 in any convenient fashion.

Figure 7:
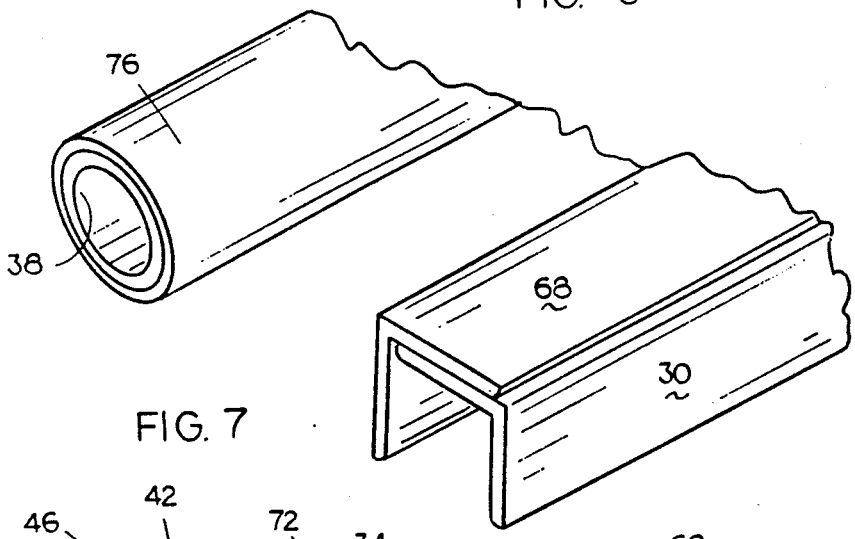
FIG. 7 is an enlarged partial sectional view illustrating the auxiliary holder mounted on the primary holder.
Figure 8:
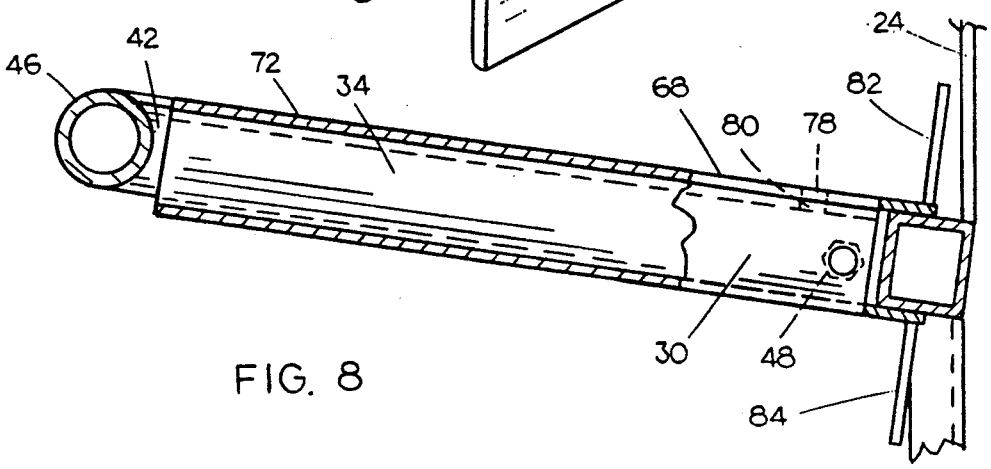
FIG. 8 is a sectional view illustrating the auxiliary holder mounted on the primary holder.

The numeral 62 refers generally to an auxiliary holder unit which may be positioned on the holder 10 to facilitate a cord or the like being mounted thereon with the unit 62 then being removable from the main unit thereby giving the combination additional storage handling capabilities. Unit 62 includes a channel-shaped back member 64 having angle members 66 and 68 secured to the opposite ends thereof which extend forwardly and slightly upwardly therefrom at approximately a 10° angle with respect to the horizontal. Hollow support members or teeth 70, 72, 74 and 76 are secured to the channel-shaped member 64 in a spaced apart relationship between the angle members 66 and 68 and also extend forwardly and slightly upwardly from the channel member 64. The rearward end of angle member 68 is provided with an opening 78 which is adapted to register with opening 80 formed in the rear end of angle member 30 when unit 62 is mounted on the main unit 10. When so mounted, a suitable hook may be extended through the openings 78 and 80 to maintain unit 62 on the main unit. When the unit 62 is mounted on the main unit, teeth 32, 34, 36 and 38 extend through the teeth 70, 72, 74 and 76 respectively while the angle members 66 and 68 rest on angle members 28 and 30 respectively as seen in FIGS. 7 and 8. Brackets 82 and 84 are provided on channel member 64 to enable the unit 62 to be supported on some sort of vertically disposed surface at times when not mounted on holder 10.

When it is desired to store an extension cord 11 or other member on the holder 10, gate means 40 is first raised to the inoperative position of FIG. 1 with the ear 58 maintaining the gate 40 in its inoperative position. The cord is then looped over support members or teeth 32, 34, 36 and 38 in the manner illustrated in FIG. 2 so that the cords are loaded or looped over any of the four teeth 32, 34, 36 or 38. When the cord is so positioned, the gate 40 is lowered from the position of FIG. 1 to the position of FIG. 2. If the holder 10 and the cord thereon is to be moved from one location to another, the hook 56 will be extended through the openings 52 and 54 to maintain the gate means 40 in its locked position so that the cord cannot be pulled from the teeth 32, 34, 36 and 38.

When it is desired to remove the cord 11 from the holder 10, hook 56 is removed and allowed to hang loosely. The end of the cord 11 is then grasped and pulled from the holder 10 which causes each loop to come off the holder 10 in the same way it was positioned thereon. The gravity of the gate means 40 lets each loop separately slip under or raise the gate slightly and then fall clear of the other hanging loops. You can remove the cord as fast as you can pull the same therefrom.

It is preferred that the teeth 32, 34, 36 and 38 extend upwardly from the frame unit at approximately a 10 angle which aids in maintaining the loops on the teeth during the removal process. A second cord may also be mounted on the holder 10 by looping the first cord over the two center teeth 34 and 36 and then looping the second cord over the four teeth. This permits either of the two cords to be removed from the holder.

The holder also permits the installation of the auxiliary unit 62 on the holder 10 so that an extension cord may be looped on the teeth 70, 72, 74 and 76 in the same fashion as the cord was looped on the main holder 10. The auxiliary unit 62 is positioned on the main holder 10 so that an electrical cord may be mounted on the auxiliary unit. When the electrical cord has been mounted on the auxiliary unit positioned on the main unit 10, the means 40 may be lowered so as to be positioned forwardly of the angle member 66, teeth 70, 72, 74, 76 and angle member 68 so as to prevent the cord from being inadvertently removed therefrom. If it is desired to remove the auxiliary unit 62 from the main holder 10, means 40 is simply raised and the auxiliary unit 62 moved forwardly with respect thereto. The auxiliary unit 62, with the cord thereon, may then be carried to the desired location.

Thus it can be seen that a novel holder has been provided for an extension cord or the like which permits the extension cord to be mounted thereon and removed therefrom without fear that the cord will become tangled during storage. The entire electrical cord may be easily removed from the holder 10, or any portion thereof, due to the unique latching operation of the gate means 40 with respect to the forward ends of the support teeth 32, 34, 36 and 38. Thus it can be seen that the invention accomplishes at least all of its stated objectives.

I claim:

1. A holder for extension cords or the like comprising, a substantially vertically disposed support means having rearward and forward sides, a plurality of substantially horizontally spaced apart elongated support members extending forwardly from said support means for receiving loops of the cord thereon, said support members having forward ends, said support members being substantially straight for their entire lengths whereby the loops of the cord may be selectively pulled therefrom.

a substantially U-shaped gate means operatively selectively pivotally mounted on said support means and being movable between first and second positions, said gate means including a pair of horizontally spaced apart, elongated side members which have rearward and forward ends and a front member extending between the forward ends thereof, said front member being positioned in front of the forward ends of said support members, when said gate means is in its said first position, to yieldably maintain said loops of said cord or the like on said support members, said gate means partially moving from its said first position towards its said second position to permit the loops of the cord or the like to be horizontally pulled from the forward ends of said support members when it is desired to remove the cord or the like from said support members.

2. The holder of claim 1 wherein means is provided for selectively locking said gate means in its said first position.

3. The holder of claim wherein means is provided for selectively maintaining said gate means in its said second position.

4. The holder of claim 1 wherein said support means includes means for securing the same to a vertically disposed supporting surface.

5. The holder of claim 1 wherein said support means includes a handle means at its upper end.

6. The holder of claim 1 wherein said support members are tubular members.

7. The holder of claim 1 wherein said support members extend forwardly and upwardly from said support means.

8. The holder of claim 1 wherein an auxiliary cord supporting apparatus is selectively removably mounted on said support members whereby an electrical cord or the like may be looped on said auxiliary cord supporting apparatus.

* * * * *